United States Patent [19]

Tates et al.

[11] 4,220,325

[45] Sep. 2, 1980

[54] SORTING APPARATUS

[75] Inventors: Donald W. Tates, Fairport; Gary A. Nobles, Webster, both of N.Y.

[73] Assignee: Xerox Corporation, Stamford, Conn.

[21] Appl. No.: 3,440

[22] Filed: Jan. 15, 1979

[51] Int. Cl.[2] ..... B65H 31/24; B65H 31/26

[52] U.S. Cl. ..... 271/293; 271/220; 271/294

[58] Field of Search ..... 271/294, 293, 292, 295, 271/296, 287, 278, 220; 270/58

[56] References Cited

U.S. PATENT DOCUMENTS

| | | | |
|---|---|---|---|
| 2,241,168 | 5/1941 | Truitt et al. | 271/294 X |
| 3,273,882 | 9/1966 | Pearson . | |
| 3,395,913 | 8/1968 | Del Vecchio et al. . | |
| 3,561,754 | 2/1971 | Gaffron et al. | 271/294 |
| 3,848,867 | 11/1974 | Johnson . | |
| 3,953,023 | 4/1976 | Cross et al. | 271/296 |
| 4,037,832 | 7/1977 | Looney | 271/294 |
| 4,068,837 | 1/1978 | Lamos | 271/296 |
| 4,162,787 | 7/1979 | Shirahase et al. | 271/293 |

*Primary Examiner*—Bruce H. Stoner, Jr.
*Attorney, Agent, or Firm*—J. J. Ralabate; C. A. Green; H. Fleischer

[57] ABSTRACT

An apparatus in which a sheet advancing along a predetermined path is collected in one of a plurality of movable sheet receiving stations. One of the receiving stations is aligned with the sheet path. A guide moves from an inoperative position spaced from the receiving stations to an operative position coupling the aligned sheet receiving station with the sheet path. This enables the sheet to advance into the receiving station.

11 Claims, 5 Drawing Figures

SORTING APPARATUS

This invention relates generally to a sorting apparatus coupled to an electrophotographic printing machine, and more particularly concerns a mechanism for collecting sheets in the sheet receiving stations of the sorting apparatus.

In an electrophotographic printing machine, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing a developer mix into contact therewith. Generally, the developer mix comprises toner particles adhering triboelectrically to carrier granules. The toner particles are attracted from the carrier granules to the latent image forming a toner powder image on the photoconductive member. Next, the toner powder image is transferred from the photoconductive member to a copy sheet. The copy sheet is then heated to permanently affix the toner particles thereto in image configuration. This general approach was disclosed by Carlson in U.S. Pat. No. 2,297,691, and has been further amplified and described by many related patents in the art.

Frequently, it is highly desirable to reproduce a plurality of copies of the same original document. Moreover, if several original documents are being reproduced, it maybe necessary to produce a plurality of collated sets of copies. This can be achieved by the utilization of a sorting apparatus. Generally, the sorting apparatus comprises a plurality of bins wherein each bin is designed to collect one set of copies of the original documents. A variety of sorters are known in the art. One type of sorter employs tray members which are spaced apart extending in a linear row. Another sorter has the tray members extending radially outwardly from the axis of rotation. There are many variations of these two basic types of sorting structures. For example, the tray members may be stationary or movable.

Copy sheets may be collected in the bins of the sorter in a number of ways. The most common technique is to utilize a sheet transport to advance the copy sheets past the bin openings with deflection fingers being used to guide the sheets from the transport into the respective bin. Another technique comprises the use of a deflection finger which moves from bin to bin to guide the copy sheets into the respective bins.

Various types of devices have hereinbefore been employed to control the movement of sheets from a printing machine to the receiving stations of a sheet sorter. The following prior art appears to be relevant:

| | |
|---|---|
| U.S. Pat. No. | 3,273,882 |
| Patentee: | Pearson |
| Issued: | September 20, 1966 |
| U.S. Pat. No. | 3,395,913 |
| Patentee: | DelVecchio et al. |
| Issued: | August 6, 1968 |
| U.S. Pat. No. | 3,848,867 |

-continued

| | |
|---|---|
| Patentee: | Johnson |
| Issued: | November 19, 1974 |

The pertinent portions of the foregoing prior art may be briefly summarized as follows:

Pearson discloses a plurality of pivotably mounted deflector fingers. A spring opposes the movement of the deflector fingers. In one position the finger deflects the sheet. The spring opposes the pivoting of the finger and returns it to a second non-deflecting position.

DelVecchio et al. describe a mechanism actuated to divert sheet material into the appropriate catch tray. Each diverter is associated with a tray and moves a corresponding gate into interference with the paper path, thereby diverting the sheet into a predetermined catch tray.

Johnson discloses a sorter having a plurality of sheet receiving stations. A deflector moves vertically past each station. The movable deflector diverts the sheet from the paper path to the selected station.

It is a primary object of the present invention to provide an improved sorting apparatus including a movable guide coupling a stationary sheet path with a receiving station aligned therewith.

Briefly stated, and in accordance with the invention, there is provided an apparatus for collecting sheets arranged to advance along a pre-determined path. The apparatus includes a plurality of sheet receiving stations. Means are provided for moving the sheet receiving station so as to align one of the sheet receiving stations with the sheet path. Guide means move from a non-operative position spaced from the receiving station to an operative position coupling the aligned sheet receiving station with the sheet path. In this manner, the sheet advancing along the pre-determined path is guided into the aligned sheet receiving station.

Other objects and advantages of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
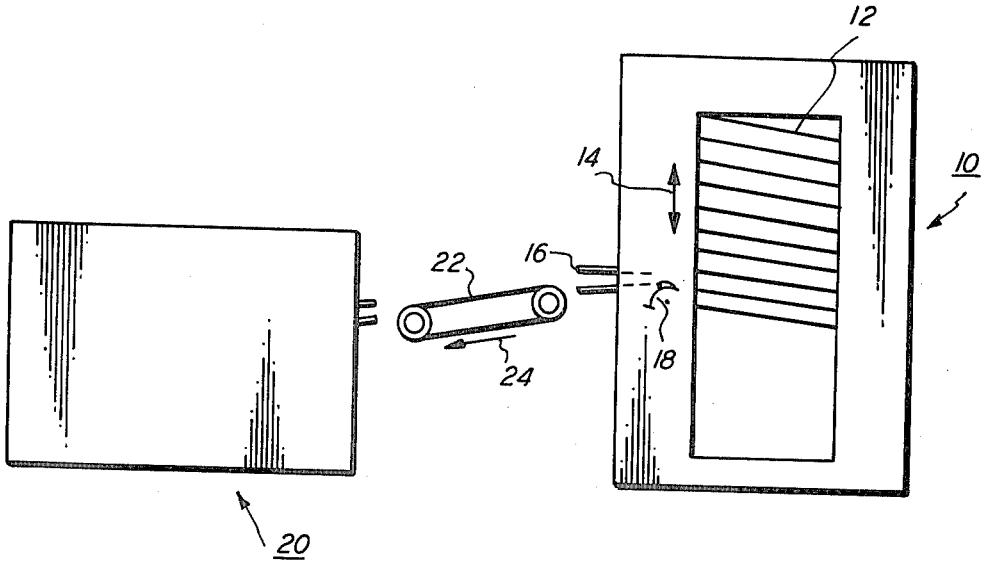
FIG. 1 is a schematic elevational view depicting a reproducing machine coupled to a sorting apparatus incorporating the features of the present invention therein.

For a general understanding of a sorting apparatus incorporating the features of the present invention therein, reference is had to the drawings. In the drawings, like reference numerals have been used throughout to designate identical elements. FIG. 1 schematically depicts an electrophotographic printing machine coupled to the sorting apparatus of the present invention.

Although the sorting apparatus is particularly well adapted for use with an electrophotographic printing machine, it will become evident from the following discussion that it is equally well suited for use with a wide variety of printing machines and is not necessarily limited in this application to the particular embodiment shown herein.

As shown in FIG. 1, the sorting apparatus, indicated generally by the reference numeral 10, includes a vertical column of movable sheet receiving stations or trays 12. Although only one column of sheet receiving stations 12 is shown, additional columns may be placed in tandem therewith provided a suitable conveyor is employed to couple each column to one another. Sheet receiving stations 12 are adapted to reciprocate in the direction of arrow 14 so as to align one of the sheet receiving stations with chute 16. A guide, indicated generally by the reference numeral 18, pivots from an inoperative position spaced from receiving stations 12 to an operative position coupling chute 16 with the aligned receiving station 12. The details of sorting apparatus 10 are depicted more fully in FIGS. 3 through 5, inclusive.

While the invention has been described in connection with a generally vertical array of sheet receiving stations or trays, one skilled in the art will appreciate that the invention is not necessarily so limited and that the array of sheet receiving stations or trays may be horizontal.

With continued reference to FIG. 1, conveyor 22 advances the copy sheet from the electrophotographic printing machine 20, in the direction of arrow 24, to chute 16. A guide 18 pivots from the inoperative to the operative position so that the advancing sheet enters one of the receiving stations 12. Thereafter, guide 18 returns to the inoperative position and receiving stations 12 translate to align the next station with chute 16. Guide 18 once again pivots to the operative position permiting the copy sheet to be advanced into the next aligned receiving station. The foregoing broadly describes the general operation of the sorting apparatus of the present invention. The detailed structure of the electrophotographic printing machine will be described hereinafter with reference to FIG. 2.

Figure 2:
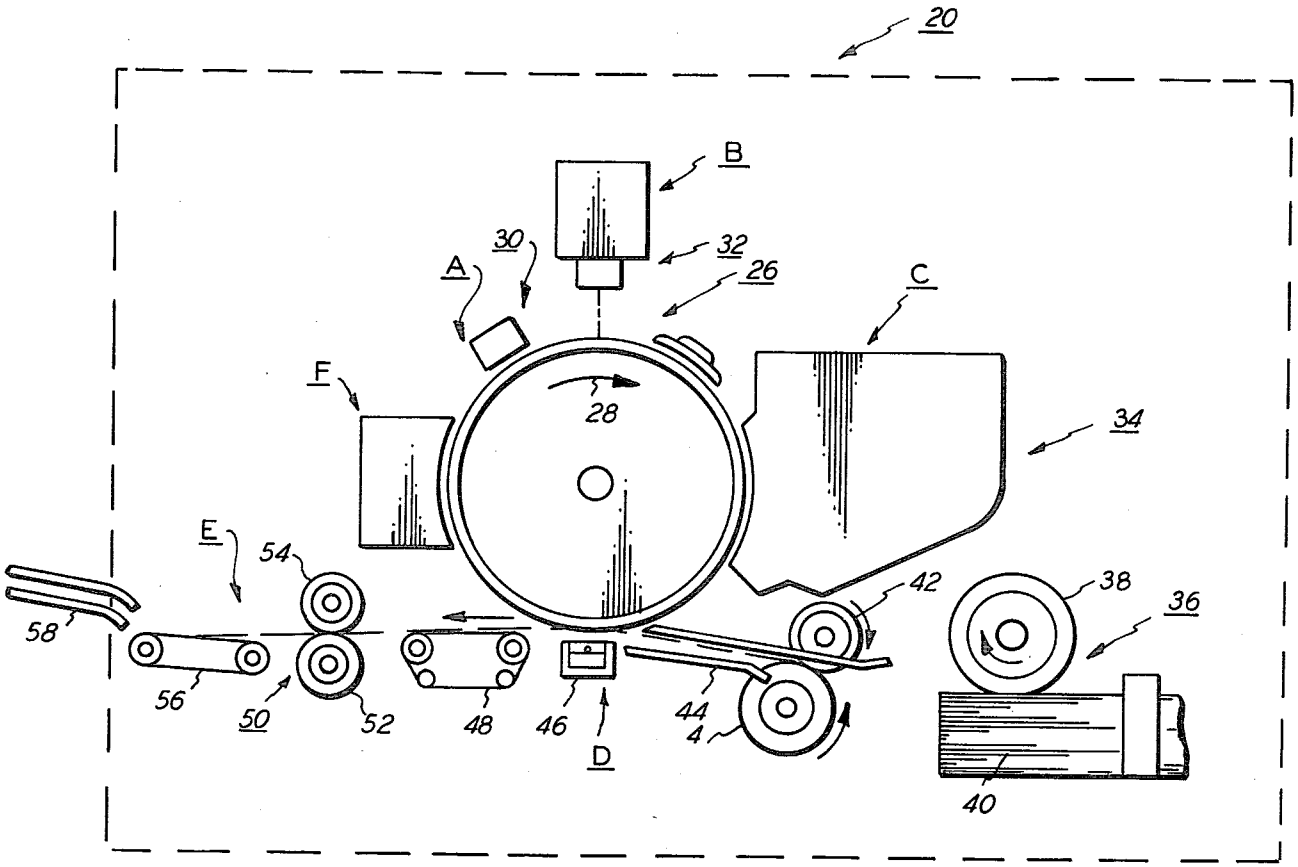
FIG. 2 is a schematic elevational view showing the FIG. 1 reproducing machine.

Referring now to FIG. 2, there is shown the detailed structure of printing machine 20. Inasmuch as the art of electrophotographic printing is well known, the various processing stations employed in the FIG. 2 printing machine will be shown hereinafter schematically and their operation described briefly with reference thereto. The electrophotographic printing machine employs a drum 26 having the outer periphery thereof coated with a suitable photoconductive material. Preferably, drum 26 is made from a conductive substrate, such as aluminum, having a photoconductive material, e.g. a selenium alloy, deposited thereon. Drum 26 rotates in the direction of arrow 28 to pass through the various processing stations disposed thereabout.

Initially, drum 26 moves a portion of the photoconductive surface through charging station A. At charging station A, a corona generating device, indicated generally by the reference numeral 30, charges the photoconductive surface of drum 10 to a relatively high, substantially uniform potential. A suitable corona generating device is described in U.S. Pat. No. 2,836,725 issued to Vyverberg in 1958.

Thereafter, the charged portion of the photoconductive surface of drum 10 is advanced through exposure station B. At exposure station B, an original document is positioned face-down on a transparent platen. The exposure system, indicated generally by the reference numeral 32, includes lamps which move across the original document illuminating incremental widths thereof. The light rays reflected from the original document are transmitted through a moving lens forming incremental width light images. These light images are projected onto the charged portion of the photoconductive surface. In this manner, the charged photoconductive surface of drum 26 is discharged selectively by the light image of the original document. This records an electrostatic latent image on the photoconductive surface of drum 26 which corresponds to the informational areas contained within the original document. A suitable exposure system is described in U.S. Pat. No. 3,832,057 issued to Shogren.

Next, drum 26 advances the electrostatic latent image recorded on the photoconductive surface to development station C. At development station C, a magnetic brush development system, indicated generally by the reference numeral 34, advances the developer mix into contact with the electrostatic latent image recorded on the photoconductive surface of drum 10. Preferably, the developer mix comprises carrier granules having toner particles adhering triboelectrically thereto. The development system forms a brush having a chain-like array of developer mix extending outwardly therefrom. The developer mix contacts the electrostatic latent image recorded on the photoconductive surface of drum 10. The latent image attracts the toner particles from the carrier granules forming a toner powder image on the photoconductive surface of drum 26. A suitable development system is disclosed in U.S. Pat. No. 3,707,947 issued to Reichart in 1973.

The toner powder image recorded on the photoconductive surface of drum 26 is then transported to transfer station D. At transfer station D, a sheet of support material is positioned in contact with the toner powder image deposited on the photoconductive surface of drum 26. A sheet of support material is advanced to the transfer station by a sheet feeding apparatus indicated generally by the reference numeral 36. Preferably, sheet feeding apparatus 36 includes a feed roll 38 contacting the uppermost sheet of the stack 40 of sheets of support material. Feed roll 38 rotates so as to advance the uppermost sheet from stack 40. Registration rollers 42 align and forward the advancing sheet of support material into chute 44. Chute 44 directs the advancing sheet of support material into contact with the photoconductive surface of drum 26 in a timed sequence so that the powder image thereon contacts the advancing sheet of support material at transfer station D.

Transfer station D includes a corona generating device 46 which applies a spray of ions to the backside of the sheet. This attracts the toner powder image from the photoconductive surface of drum 26 to the sheet. After transfer, the sheet continues to move with drum 26 and is separated therefrom by a detack corona generating device which neutralizes the charge causing the sheet to adhere to the drum. Conveyor 48 advances the sheet from the transfer station to fusing station E.

Fusing station E, indicated generally by the reference numeral 50, includes a back-up roller 52 and a heated fuser roller 54. The sheet of support material with the toner powder image thereon passes between backup roller 52 and fuser roller 54. Toner particles contact fuser roller 54 and the heat and pressure applied thereto permanently affixes them to the sheet of support material. After fusing, conveyor 56 advances the finished copy sheet to chute 58. Chute 58, in turn, guides the advancing copy sheet to conveyor 22 (FIG. 1).

Invariably, after the sheet of support material is separated from the photoconductive surface of drum 26, some residual toner particles remain adhering thereto. These residual particles are cleaned from drum 26 at cleaning station F. Preferably, cleaning station F includes a rotatably mounted fibrous brush in contact with the photoconductive surface of drum 26. The particles are cleaned from the photoconductive surface by the rotation of the brush in contact therewith. Subsequent to cleaning, a discharge lamp floods the photoconductive surface with light to dissipate any residual electrostatic charge remaining thereon prior to the charging thereof for the next successive imaging cycle.

It is believed that the foregoing description is sufficient for purposes of the present invention to illustrate the general operation of an electrophotographic printing machine coupled to the sorting apparatus of the present invention.

Figure 3:
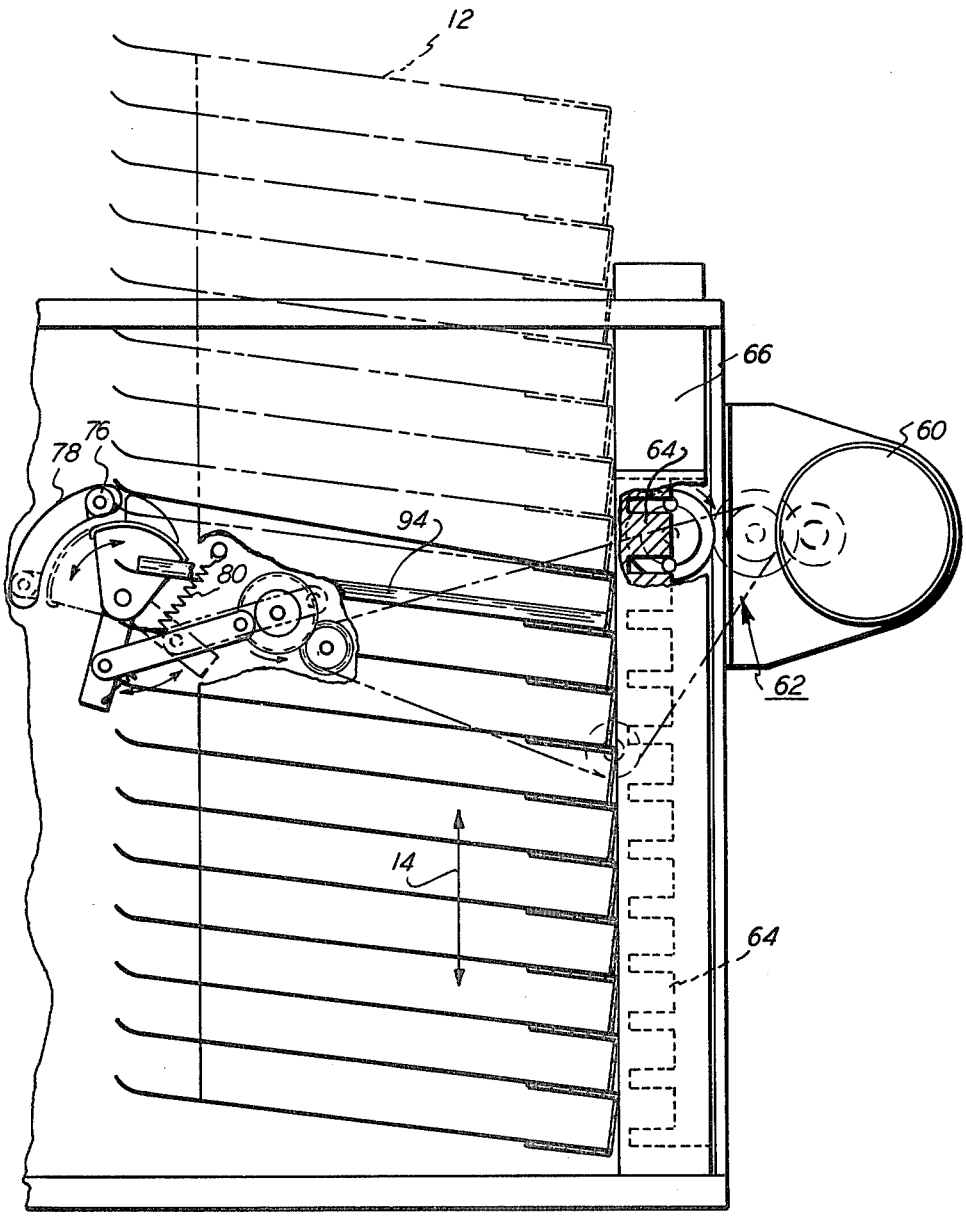
FIG. 3 is an elevational view illustrating the FIG. 1 sorting apparatus.
Figure 4:
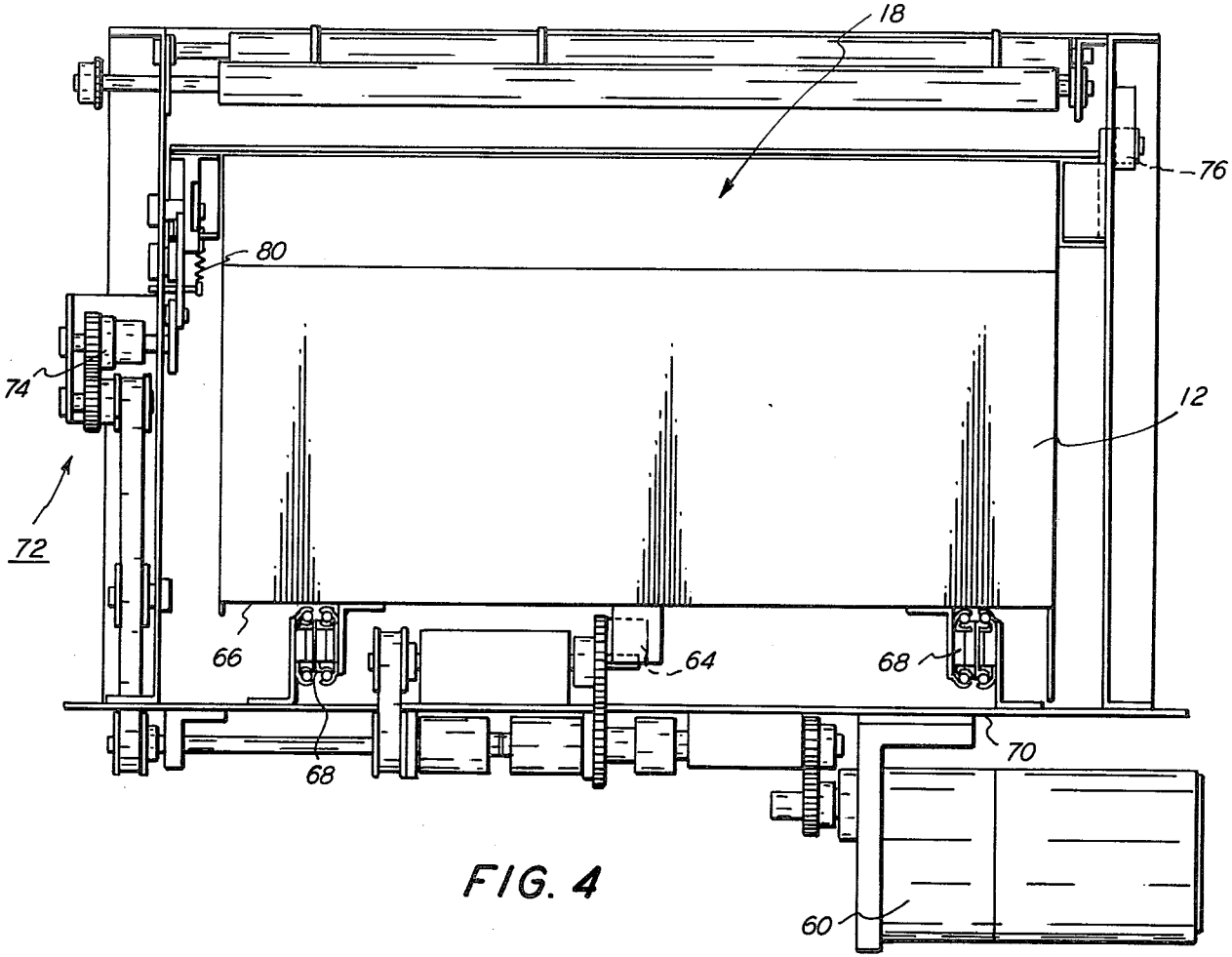
FIG. 4 is a plan view depicting the FIG. 1 sorting apparatus.

Referring now to FIGS. 3 and 4, the detailed operation of the sorting apparatus will be described hereinafter. Initially, the manner in which sheet receiving stations 12 are translated in the direction of arrow 14 will be described. Motor 60 is connected by gearing system 62 to rack 64. Actuation of a suitable electromagnetic clutching mechanism associated with belt and gearing system 62 determines the direction of translation of rack 64. Thus, when only the gears are coupled to motor 60, rack 64 translates receiving stations or trays 12 in an upwardly direction. Contrariwise, when the gears and belt are coupled to motor 60, rack 64 translates trays 12 in a downwardly direction. Trays 12 are secured to a frame 66 which, in turn, is coupled slidably to stationary frame 70 by slides 68. Preferably, slides 68 are manufactured by the Accuride Corporation of California. Motor 60 is coupled by a pulley and belt system 72 to chute 18. Clutch 74 couples and de-couples motor 60 to chute 18. Chute 18 includes a cam follower 76 riding in slot 78 of stationary frame 70. Cam 76 is mounted on one end of chute or guide 18. The belt drive is coupled to the other end of chute or guide 18. Guide 18 is mounted pivotably on stationary frame 70. Spring 80 is connected to chute 16. When clutch 74 de-couples pulley and belt system 72 from chute 18, spring 80 pivots chute 18 to the inoperative position. Chute 18 is pivoted from the inoperative position to the operative position, when clutch 74 couples pully and belt system 72 to motor 60. The torque applied on chute 18 overcomes the torque of spring 80 driving chute 18 from the inoperative position to the operative position coupling chute 16 with the receiving station aligned therewith. Cam follower 76, which is secured to chute 18, is disposed in arcuate slot 78. This provides an external guide to insure uniform rotation of chute 18.

Figure 5:
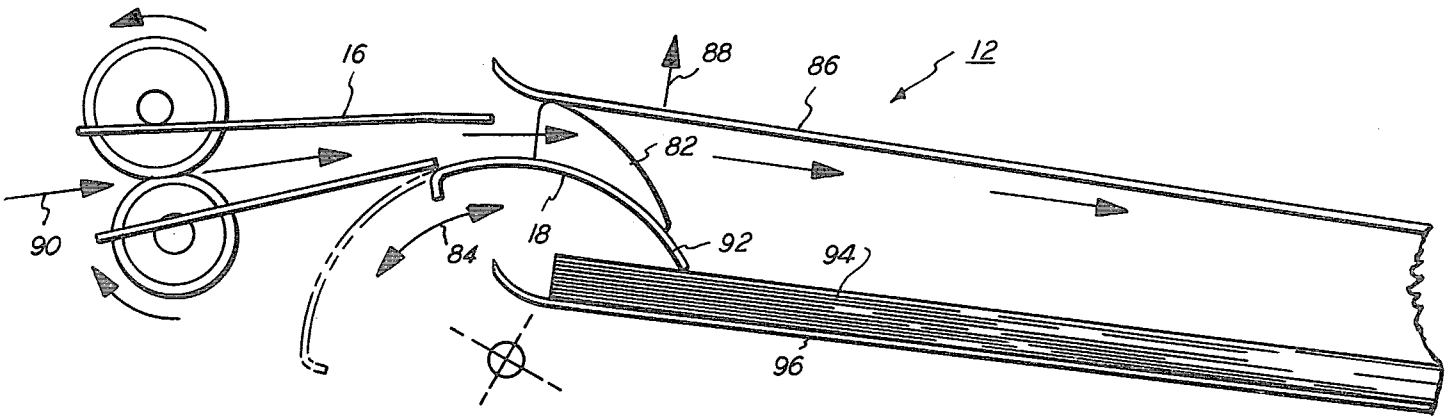
FIG. 5 is a fragmentary elevational view showing the operation of the FIG. 1 sorting apparatus.

Turning now to FIG. 5, there is shown the detailed operation of chute 18. As shown therein, chute 18 is in the operative position coupling chute 16 with sheet receiving station 12. Chute 18 includes two cams 82 (only one shown) secured fixedly to each end portion thereof. Chute 18 pivots in the direction of arrow 84 from the inoperative position to the operative position. As chute 18 moves into the operative position, cams 82 engage upper tray 86 of receiving station 12. This causes tray 86 to open, i.e. pivot in the direction of arrow 88. In this way, the mouth of sheet receiving station 12 is opened permitting a sheet advancing through chute 16 to pass over chute 18 and into receiving station 12. The advancing sheet moves in the direction of arrow 90. As shown in FIG. 5, the leading edge 92 of chute 18 depresses the sheets previously stacked into receiving station 12. This further opens the entrance of receiving station 12 permitting the ready receipt of the copy sheet being advanced therein. As the copy sheet advances in the direction of arrow 90, the leading marginal region thereof passes over chute 18 into receiving station 12. At this time, i.e. after only a portion of the copy sheet has entered receiving station 12, e.g. about the leading 7.5 cm. of the copy sheet, chute 18 pivots in the opposite direction returning to the inoperative position. The copy sheet continues to advance into the receiving station, while the receiving stations are translated aligning the next successive receiving station with chute 16. After the next successive receiving station has been aligned with chute 16, chute 18 pivots from the inoperative position to the operative position repeating the foregoing sequence of events. Preferably guide or chute 18 is made from curved sheet metal.

As shown in FIG. 5, the sheets 94 previously positioned in receiving station 12 are supported by tray 96. It should be noted that each receiving station 12 includes the upper surface of tray 96 and the under surface of tray 86 as well as the space defined therebetween.

In recapitulation, it is evident that the sorting apparatus of the present invention includes a plurality of movable sheet receiving stations. Each sheet receiving station is aligned with the sheet path. A sheet guide or chute pivots from an inoperative position to an operative position coupling the sheet path with the aligned sheet receiving station. This permits the advancing sheet of support material to advance into the sheet receiving station. In addition, the sheet guide compresses the stack of sheets previously disposed in the receiving station. Moreover, the sheet guide opens the receiving station. Both the opening of the receiving station and the depressing of the stack of sheets previously deposited therein facilitates the advancement of the new sheet thereto. Furthermore, the sheet guide is arranged to move from the operative position coupling the sheet path to the aligned sheet receiving station to the inoperative position spaced from the receiving station after only a portion of the sheet has entered the receiving station. This early retraction feature provides additional time for indexing the next successive sheet receiving station into alignment with the paper path.

It is, therefore, evident that there has been provided in accordance with the present invention, an apparatus for sorting sheets that fully satisfies the objects, aims and advantages hereinbefore set forth. While this invention has been described in conjunction with a specific embodiment thereof, it will be evident that many alternatives, modifications, and variations will be apparent to those skilled in the art. Accordingly, it is intended to embrace all such alternatives, modifications, and variations as fall within the spirit and broad scope of the appended claims.

What is claimed is:

1. An apparatus for collecting sheets arranged to advance along a pre-determined path, including:

a plurality of sheet receiving stations, each of said stations comprising a sheet supporting tray supported movably in a spaced relationship with the next adjacent tray; and means, arranged to move from an inoperative position spaced from said plurality of sheet receiving stations to an operative position coupling one of said plurality of sheet receiving stations with the pre-determined path, for guiding a sheet advancing along the pre-determined path therealong into said one of said plurality of sheet receiving stations, said guiding means increasing the size of the entrance space of said one of said plurality of sheet receiving stations by moving an adjacent tray away from the tray at said one of said plurality of stations thereby opening said station and by depressing the sheets previously advanced into said one of said plurality of sheet receiving stations.

2. An apparatus as recited in claim 1, wherein said guiding means moves from the operative position to the inoperative position with only a portion of the sheet having advanced into the aligned one of said plurality of sheet receiving stations.

3. An apparatus as recited in claim 1, wherein said guiding means includes a curved portion mounted pivotably so that, in the operative position, the trailing edge region is adjacent the sheet path with the leading edge region being adjacent the aligned one of said plurality of sheet receiving stations.

4. An apparatus as recited in claim 3, wherein said guiding means includes at least one cam secured to said curved portion, said cam being arranged to open the aligned one of said plurality of sheet receiving stations as said curved portion pivots from the inoperative position to the operative position.

5. An apparatus as recited in claim 3, wherein the leading edge region of said curved portion, in the operative position, depresses the sheets previously advanced into the aligned one of said plurality of sheet receiving stations to facilitate the advancement of the next successive sheet therein.

6. An apparatus as recited in claims 4 or 5, wherein said plurality of sheet receiving stations include a plurality of trays having at least a portion thereof supported in a spaced relationship with each other.

7. An apparatus as recited in claim 1, wherein said plurality of sheet receiving stations are arranged in a generally vertical array.

8. An apparatus as recited in claim 1, in which the sheets are copies of original documents with the copies being reproduced in an electrophotographic printing machine, further including means for advancing the sheets from the electrophotographic printing machine along the pre-determined path to said guiding means.

9. An apparatus as recited in claim 1, wherein said guiding means includes a leading marginal region arranged to depress the sheets previously advanced into said tray coupled therewith.

10. An apparatus as recited in claim 1, wherein said guiding means includes a cam member arranged to move one of said plurality of trays to increase the space between adjacent ones of said plurality of trays.

11. An apparatus as recited in claim 10, wherein said guiding means includes a leading marginal region arranged to depress the sheets previously advanced into said tray coupled therewith.

* * * * *